United States Patent [19]

Schär

[11] 4,419,791

[45] Dec. 13, 1983

[54] METHOD OF UNROLLING AND PIECING A LAP

[75] Inventor: Hugo Schär, Neftenbach, Switzerland

[73] Assignee: Rieter Machine Works Limited, Winterthur, Switzerland

[21] Appl. No.: 447,312

[22] Filed: Dec. 6, 1982

Related U.S. Application Data

[63] Continuation of Ser. No. 928,894, Jul. 28, 1978, abandoned.

[30] Foreign Application Priority Data

Aug. 24, 1977 [CH] Switzerland ..... 10361/77

[51] Int. Cl.[3] ..... D01G 19/08

[52] U.S. Cl. ..... 19/215; 19/123; 19/236

[58] Field of Search ..... 19/122, 123, 124, 115, 19/215, 220, 223, 232, 235, 243, 293, 115 R, 236; 242/65, 66, 78.6, 78.7

[56] References Cited

U.S. PATENT DOCUMENTS

| | | | |
|---|---|---|---|
| 1,659,352 | 2/1928 | Craven | 19/123 |

FOREIGN PATENT DOCUMENTS

| | | | |
|---|---|---|---|
| 22045 | of 1910 | United Kingdom | 19/123 |
| 9996 | of 1912 | United Kingdom | 19/123 |
| 340686 | 1/1931 | United Kingdom | 19/122 |
| 474612 | 11/1937 | United Kingdom | 19/243 |
| 592643 | 9/1947 | United Kingdom | 19/293 |

OTHER PUBLICATIONS

Saco Lowell Bulletin (Drawing Frame) Sep.-Oct. 1932, pp. 4-5.

*Primary Examiner*—Louis Rimrodt
*Attorney, Agent, or Firm*—Werner W. Kleeman

[57] ABSTRACT

A method of unrolling and piecing a lap and a lap drive for combing machines, lap drafters and similar machines having a driven pair of support rolls for supporting the lap to be unrolled for processing. One of the support rolls is uncoupled from its drive for unrolling and for piecing the fiber layer.

3 Claims, 2 Drawing Figures

METHOD OF UNROLLING AND PIECING A LAP

CROSS REFERENCE TO RELATED APPLICATION

This application is a continuation application of my commonly assigned, copending U.S. application Ser. No. 928,894, filed July 28, 1978, now abandoned.

BACKGROUND OF THE INVENTION

The present invention relates to a new and improved method of unrolling and piecing a lap, and to an improved construction of a lap drive for combing machines, lap drafters and similar machines.

Equipment of this type is known to the art incorporating a driven pair of support rolls for supporting the lap to be unrolled for processing.

With state-of-the-art combers and lap drafters a new lap is placed onto the stopped support rolls during replacement of the empty lap tube. For the purpose of piecing the new fiber layer to the end of the old fiber layer the operator is required to lift the lap off the support rolls and then unrolls a sufficiently long piece of the fiber layer for the purpose of piecing the same to the fiber layer which is in the process of running-out. The piecing operation occurs after the lap has been placed back onto the support rolls.

Hence, the operator, for each lap exchange, lifts the new, heavy lap for a certain period of time and simultaneously rotates such lifted lap and thereafter pieces the fiber layer which has been unrolled from the new lifted lap to the end of the old fiber layer without damaging the unrolled piece of fiber layer.

This manual work is extremely tedious inasmuch as the weight of each lap amounts to about 14 kilograms and an operator is required to perform as many as sixty lap exchanges per hour.

In consideration of the tendency of using larger, and thus, also considerably heavier laps, it is extremely desirable to eliminate this strenuous manual work.

SUMMARY OF THE INVENTION

Therefore, it is a primary object of the present invention to provide a new and improved method of unrolling and piecing a lap and to an improved construction of lap drive for combing machines, lap drafters and similar machines which fulfills these requirements in an extremely simple and reliable fashion.

Another and more specific object of the present invention aims at devising a novel lap unrolling and piecing method and a lap support apparatus or lap drive, by means of which it is possible to also unroll and piece a fiber layer from heavy laps in an extremely simple and relatively effortless manner.

Yet a further significant object of the present invention is to provide a new and improved method of unrolling and piecing a lap and to an improved construction of lap drive for combing machines, lap drafters and similar machines, which lap drive is relatively simple in design, economical to manufacture, extremely reliable in operation, allows an operator to work with heavy laps with a minimum of effort and manual exertion, and enables lap handling in a simple and less tedious manner.

Now in order to implement these and still further objects of the invention, which will become more readily apparent as the description proceeds, the invention contemplates providing a support roll having a drive for the support roll, wherein the drive is operatively connected with the support roll by means of a clutch or the like. The support roll is disconnected or uncoupled from its drive for the purpose of unrolling and piecing the fiber layer.

The inventive method of unrolling and piecing a lap for combing machines, lap drafters and the like comprises the steps of: supporting the lap on a pair of rolls, at least one of said rolls being connected to a drive which can be selectively engaged and disengaged; disengaging said drive to said one roll to render said roll freely rotatable whereby a fiber layer of the lap can be easily unrolled therefrom; piecing the fiber layer of said lap to the fiber layer of another lap; and thereafter engaging said drive to said roll whereby the lap is thus driven and the fiber layer is therefore unrolled from said lap without being drafted.

BRIEF DESCRIPTION OF THE DRAWINGS

The present invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
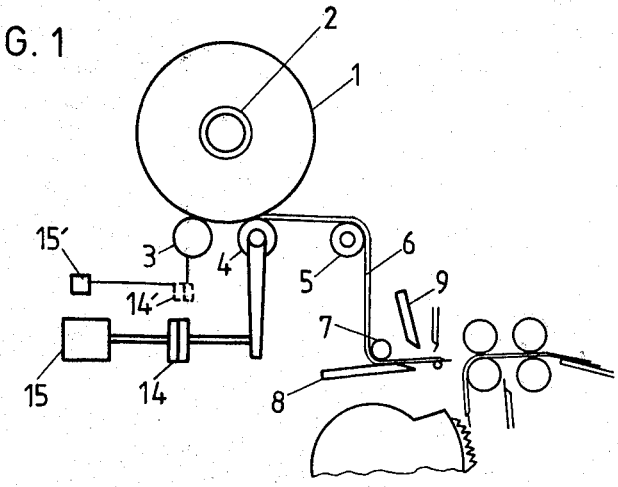
FIG. 1 is a schematic view of a fiber layer supply on a combing machine.

Describing now the drawings, it is to be understood that only enough of the relevant textile machine has been shown and will be considered in the description to follow, in order to simplify the illustration thereof and as is needed for those skilled in the art to readily understand the underlying principles and concepts of the present invention. Turning attention now to the arrangement of FIG. 1, there is shown therein part of a combing machine having a fiber layer supply arrangement embodying the teachings of the invention. More particuarly, there will be seen a lap 1 having a lap tube 2 and rotatably supported on a pair of suppoert rolls 3 and 4. The unrolled fiber layer 6 which is payed-off the lap 1 passes over a shaft 5 and a supply roll 7 and between a lower clamp 8 and an upper clamp 9. The unrolled fiber layer 6 is held between the lower clamp 8 and the upper clamp 9 and offered to, in this case, for instance a circular comb of a conventional combing machine.

In the exemplary embodiment under discussion the support roll 4 is operatively connected with a suitable drive or drive means 15 by means of a clutch 14 or equivalent structure which can be selectively engaged and disengaged, i.e. coupled and uncoupled, whereas the other support roll 3 freely rotates. In this arrangement it is of absolutely no importance whether the clutch 14 is activated mechanically, magnetically or electrically. Equally, it should be appreciated that it would of course be possible to drive both support rolls 3 and 4 and to provide such with a clutch, a schematically indicated by reference character 14', while reference character 15' schematically indicates the clutch drive.

Figure 2:
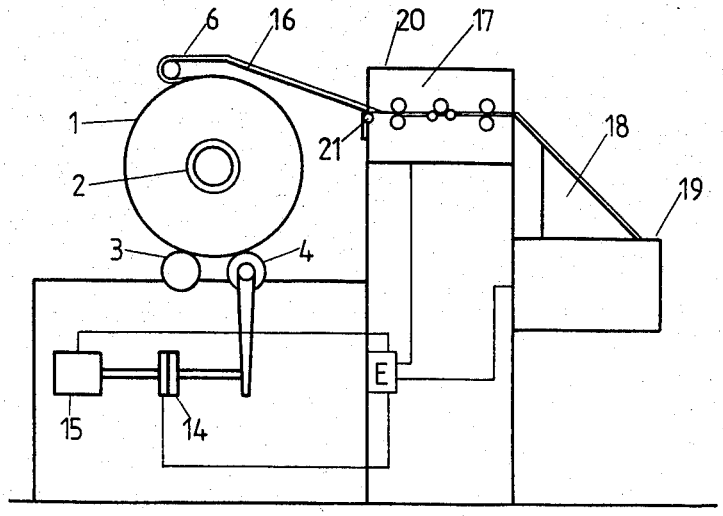
FIG. 2 is a schematic view of the fiber layer supply on a lap drafter.

Continuing, in FIG. 2 there is shown a lap creel and fiber layer supply device of a lap drafter, wherein as a matter of convenience elements corresponding to those of the comber or combing machine shown in FIG. 1 have been designated with the same reference characters.

Here also for the purpose of taking-up the lap 1 there are likewise provided the support rolls 3 and 4, at least one of which support rolls, here the support roll 4, is operatively connected with its related drive 15 by means of a clutch 14 or equivalent structure. The fiber layer 6 which is unrolled from the lap 1 is supplied to a drafting arrangement 17 by means of an infeed supporting arrangement or guide or support table 16. Upon leaving the drafting arrangement 17 the now drafted fiber layer 6 is deposited by means of a so-called deflecting plate 18 upon a table 19 and combined, as by doubling, with other fiber layers (now shown) processed in drafting arrangements neighboring the one which has just been described.

The input support table 16, which is arranged on the frame or housing 20 of the drafting arrangement 17, is articulated by means of hinges or pivots 21 or equivalent structure in such a manner that the input table 16 can be pivoted-up whenever a new lap 1 is creeled.

In contrast to conventional combers and lap drafters, the teachings of the invention contemplate piecing the fiber layer and pulling such in a most simple manner and without any appreciable expenditure in force in the following manner:

A full lap 1 is rolled or deposited in known manner manually or by means of a suitable lap loading device onto the pair of support rolls 3 and 4. Subsequently, the driven support roll 4 is disengaged, i.e., mechanically, from the associated drive mechanism or drive 15 by de-activating clutch 14, and thus, is rendered freely rotatable. Now the fiber layer 6 can be easily unrolled or unraveled from the lap 1 and is pieced to the end of the fiber layer which has already been processed.

Before the comber or the lap drafter, as the case may be, is restarted into operation, the clutch 14 is again activated i.e., engaged, in a manner such that the lap 1 is now driven and, hence, the fiber layer 6 is therefore unrolled from the lap 1 without being drafted.

In order to even further simplify this operation, the input support table 16, which may be considered to constitute a guide plate, is arranged on the housing or frame 20 of the lap drafter, here more specifically the housing or frame of the drafting arrangement 17 as previously discussed, and such input table or guide plate 16 extends considerably over the apex of the lap 1 and forms a long table. The two lap ends can be easily pieced on this table which provides a convenient work surface.

According to a further embodiment of the invention, the clutches 14 of the adjacent pairs of input or support rolls can be simultaneously disengaged upon deactivation of the drives 15 and the other machine drives and can be again engaged when these drives are again started-up. This has been found to be advantageous since for the lap exchange process the entire machine in any case is always stopped. With this arrangement the clutches 14 are preferably connected with a common source of energy E for all of the drives.

By virtue of the inventive apparatus it is possible to eliminate in a most simple manner the tiring manual labor already during processing smaller, light laps, and without any increased effort, of course, there can be used much larger, heavier laps.

With very little further expenditure it is possible to incorporate the invention on machines which are already installed and in use, and these advantages can be attained by adapting existing machines by installing a clutch between the support roll drive mechanism and the support rolls.

While there are shown and described present preferred embodiments of the invention, it is to be distinctly understood that the invention is not limited thereto, but may be otherwise variously embodied and practiced within the scope of the following claims, accordingly.

What I claim is:

1. A method of unrolling and piecing a lap for combing machines, lap drafters and the like, comprising the steps of:

supporting the lap on a pair of rolls, at least one of said rolls being connected to a drive which can be selectively engaged and disengaged;

disengaging said drive to said one roll to render said roll freely rotatable whereby a fiber layer of the lap can be easily unrolled therefrom;

piecing the fiber layer of said lap to a fiber layer of another lap; and thereafter engaging said drive to said roll, whereby the lap is thus driven and the fiber layer is therefore unrolled from said lap without being drafted.

2. A method of piecing laps in a textile machine fed by an operator with heavy laps and having a lap drive comprising a pair of support rolls for supporting a lap which is to be unrolled for processing a drive for at least one of the support rolls, the drive being normally coupled to said one support roll to rotate it to unroll a lap supported thereon, said method comprising the steps of:

uncoupling said drive so that both rolls can rotate freely to permit manual unrolling of a length of fiber layer from a heavy lap supported by said rolls; and piecing said length of fiber layer to the end of a lap already being processed.

3. The method as defined in claim 2, wherein:

both said rolls are driven and both are uncoupled for piecing.

* * * * *